US006027267A

United States Patent [19]

Yokobori

[11] Patent Number: 6,027,267

[45] Date of Patent: Feb. 22, 2000

[54] KEYBOARD HAVING KEY TOPS WITH HINGES

[75] Inventor: Syuuya Yokobori, Isesaki, Japan

[73] Assignee: Hosiden Corporation, Osaka, Japan

[21] Appl. No.: 09/208,436

[22] Filed: Dec. 10, 1998

[30] Foreign Application Priority Data

Dec. 16, 1997 [JP] Japan ..... 9-346441

[51] Int. Cl.[7] ..... B41J 5/12; H01H 13/70

[52] U.S. Cl. ..... 400/479; 200/343

[58] Field of Search ..... 400/472, 479, 400/479.1, 479.2, 490; 200/343

[56] References Cited

U.S. PATENT DOCUMENTS

| | | | |
|---|---|---|---|
| 4,032,729 | 6/1977 | Koistinen | 200/343 |
| 4,160,886 | 7/1979 | Wright et al. | 200/343 |
| 4,315,114 | 2/1982 | Monti, Jr. | 200/343 |
| 4,486,637 | 12/1984 | Chu | 200/343 |
| 4,845,319 | 7/1989 | Watkins et al. | 200/343 |
| 4,967,467 | 11/1990 | Udagawa | 200/343 |
| 5,912,443 | 6/1999 | Hasunuma | 200/343 |

*Primary Examiner*—John Hilten
*Assistant Examiner*—Leslie J. Grohusky
*Attorney, Agent, or Firm*—Pollock, Vande Sande & Amernick

[57] ABSTRACT

A keyboard in which raised portions are embossed on a rubber sheet in correspondence to the respective switches of a membrane switch so that the raised portions may be pressed down to actuate the switches. A housing made of highly rigid synthetic resin is provided which has openings formed therethrough. A key top is disposed within each of the openings and formed integrally with the housing by means of at least two hinges. Each of the widthwise delimiting regions formed integrally with the housing between each widthwise adjacent openings has notches cut in from adjacent openings in depthwise staggered position. Each of the key tops has engagement tabs extending oppositely outward from two opposed side edges thereof adjoining the side edge where the hinges are formed and entering into the notches. A face panel having key top openings formed therethrough and arrayed in correspondence to the key tops is attached to the upper surface of the housing. The notches are covered from above by the corresponding widthwise dividing regions of the face panel over the widthwise delimiting regions of the housing to act as stops for the engagement tabs.

9 Claims, 5 Drawing Sheets

KEYBOARD HAVING KEY TOPS WITH HINGES

BACKGROUND OF THE INVENTION

This invention relates to a keyboard, and particularly to a low-profile keyboard comprising key tops, hinges and a housing, all integrally molded.

Referring to Figs. 1A and 1B, an example of the prior art keyboard will first be described. FIG. 1A is a top plan view illustrating key tops of the keyboard while FIG. 1B is a cross-sectional view taken on line 1B—1B and viewed in the direction indicated by the arrows in FIG. 1A.

In FIGS. 1A and 1B, designated at 10 is a housing of keyboard. The housing 10 has openings 11 formed at regular intervals through which the respective square-shaped key tops 2 are exposed. It is noted here that the key tops 2 are formed integrally with the housing 10 by means of respective hinges 22. Each of the key tops 2 is formed with engagement flaps designated at 21 on its opposite sides adjacent the portions where the hinges 22 are formed. Indicated at 3 is an elastic sheet. Shown at 31 are raised portions embossed in the form of a convex dome on the rubber sheet 3. Each of the raised portions 31 has a protrusion 32 extending from the undersurface thereof. 4 is a movable-contact sheet having movable contacts 41 formed on the undersurface thereof in correspondence to the respective key tops 2. 5 is a fixed-contact sheet bonded to the upper surface of a substrate 8 supporting the entire keyboard. The fixed-contact sheet 5 has fixed contacts 51 formed thereon in opposed relation with the respective movable contacts 41. The opposed fixed contacts and movable contacts constitute contact pairs 71. 6 is a separator formed of synthetic resin sheet having apertures 61 stamped out therethrough to define void spaces in which the respective movable contacts 41 and fixed contacts are opposed to each other. The movable-contact sheet 4, the fixed-contact sheet 5, and the separator 6 together constitute a membrane switch (sheet) 7.

With the keyboard shown in FIGS. 1A and 1B, upon being pressed down, the key top 2 is displaced downwardly about the hinges 22 to cause the protrusion 32 to elastically deform the associated raised portion 31 on the rubber sheet 3 downwardly, which in turn elastically deforms the associated movable contact 41 on the movable-contact sheet 4 downwardly into contact with the fixed contact 51 on the fixed-contact sheet 5 to thereby close the associated contact pair. Releasing the pressure on the key top 2 allows the raised portion 31 to return to its original position to open the contact pair 71.

In the keyboard as shown in FIGS. 1A and 1B, it may be desirable to reduce the width dimension of the keyboard as well as making the thickness extremely thin. In this case, by integrally molding the housing 10, key tops 2 and hinges 22 of highly rigid synthetic resin it is possible to construct a low-profile keyboard in which the entire keyboard including the housing 10, rubber sheet 3, membrane switch 7 and substrate 8 is, say 0.2 cm in thickness (height) and 10 cm×25 cm in depth and width.

In this regard, it should be noted that synthetic resin material having high rigidity is generally mechanically fragile. When the housing 10, key tops 2 and hinges 22 are integrally molded of such material, the hinges 22 will fracture by fatigue due to operations of the key tops 2 repeated frequently in a short period of time, resulting in shortening the useful life of the keyboard. It is hard to say that the synthetic resin material is suitable in reducing the width and depth dimensions of the keyboard since the length of the hinges 22 is compelled to be relatively long because of the mechanical fragility as well as high rigidity of the synthetic resin material of which the hinges 22 are formed.

SUMMARY OF THE INVENTION

It is an object of this invention to provide a keyboard which is relatively small in the width and depth dimensions, low in the height profile and has a long useful life, thereby having overcome the aforementioned problems.

According to this invention, in a keyboard in which raised portions are embossed on a rubber sheet in correspondence to the respective switches of a membrane switch so that the raised portions may be pressed down to actuate the switches, a housing made of highly rigid synthetic resin is provided which has square shaped openings formed therethrough and arrayed at intervals both in the width direction and in the depth direction. A key top is disposed within each of the openings and formed integrally with the housing by means of at least two hinges. Each of the widthwise delimiting regions formed integrally with the housing between each widthwise adjacent openings has notches cut in from two opposed side edges of the widthwise adjacent openings in depthwise staggered position. Each of the key tops has engagement tabs extending oppositely outward from two opposed side edges thereof adjoining the side edge where the hinges are formed and entering into the notches. A face panel having key top openings formed therethrough and arrayed in correspondence to the key tops is attached to the upper surface of the housing. The notches are covered from above by the corresponding widthwise dividing regions of the face panel over the widthwise delimiting regions of the housing to act as stops for the engagement tabs.

DETAILED DESCRIPTION OF THE PREFERRED EMBODIMENTS

The embodiment of this invention will be described with reference to the accompanying drawings.

Figure 1A:
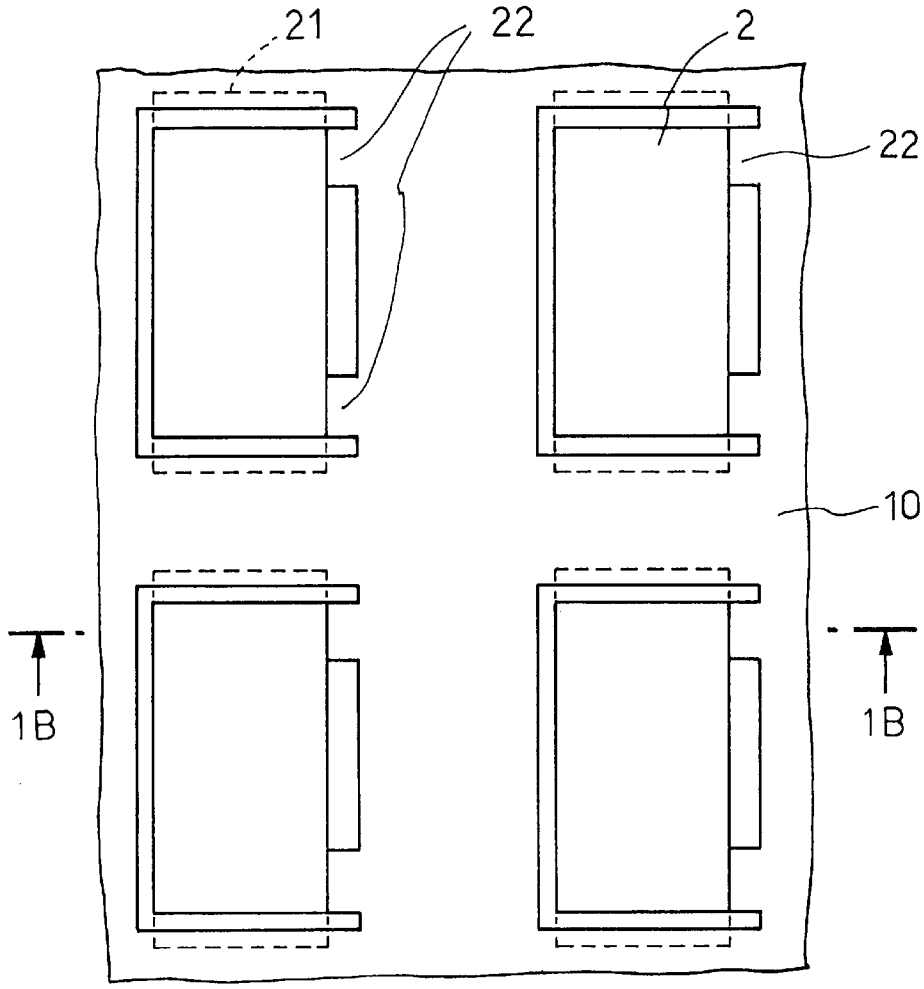
FIG. 1A PRIOR ART
FIG. 1A is a plan view illustrating an example of the prior art keyboard.
Figure 1B:
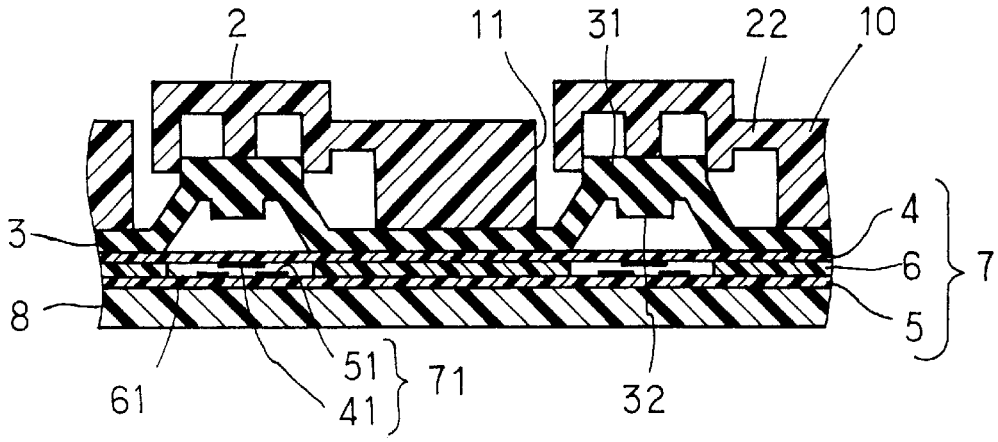
FIG. 1B PRIOR ART
FIG. 1B a cross-sectional view taken on line 1B—1B in FIG. 1A.
Figure 2A:
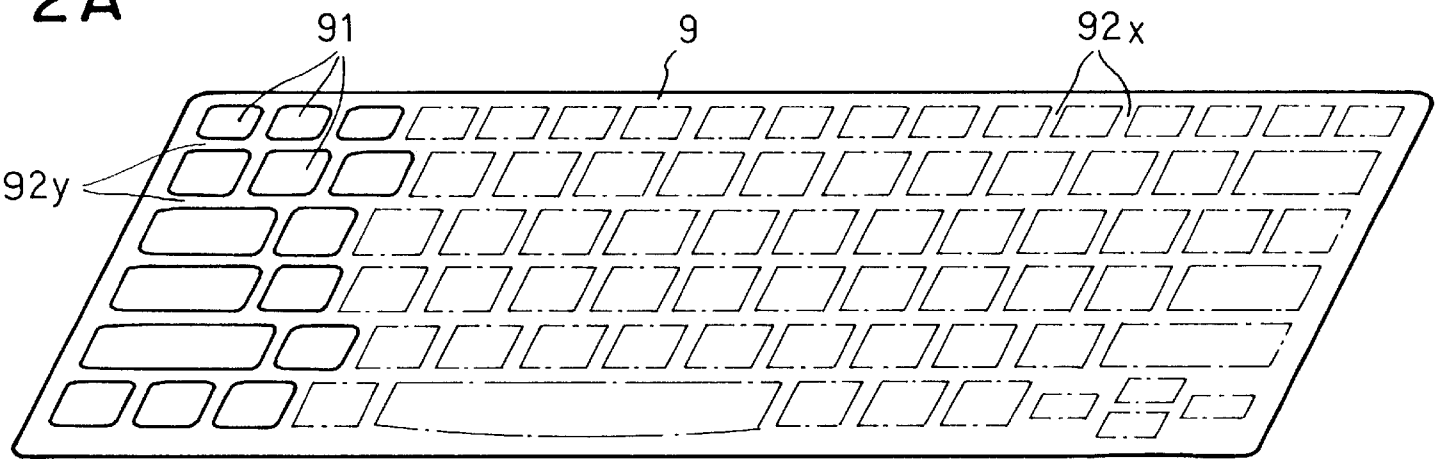
FIG. 2A is a perspective view of the face panel of the keyboard according to this invention.
Figure 2B:
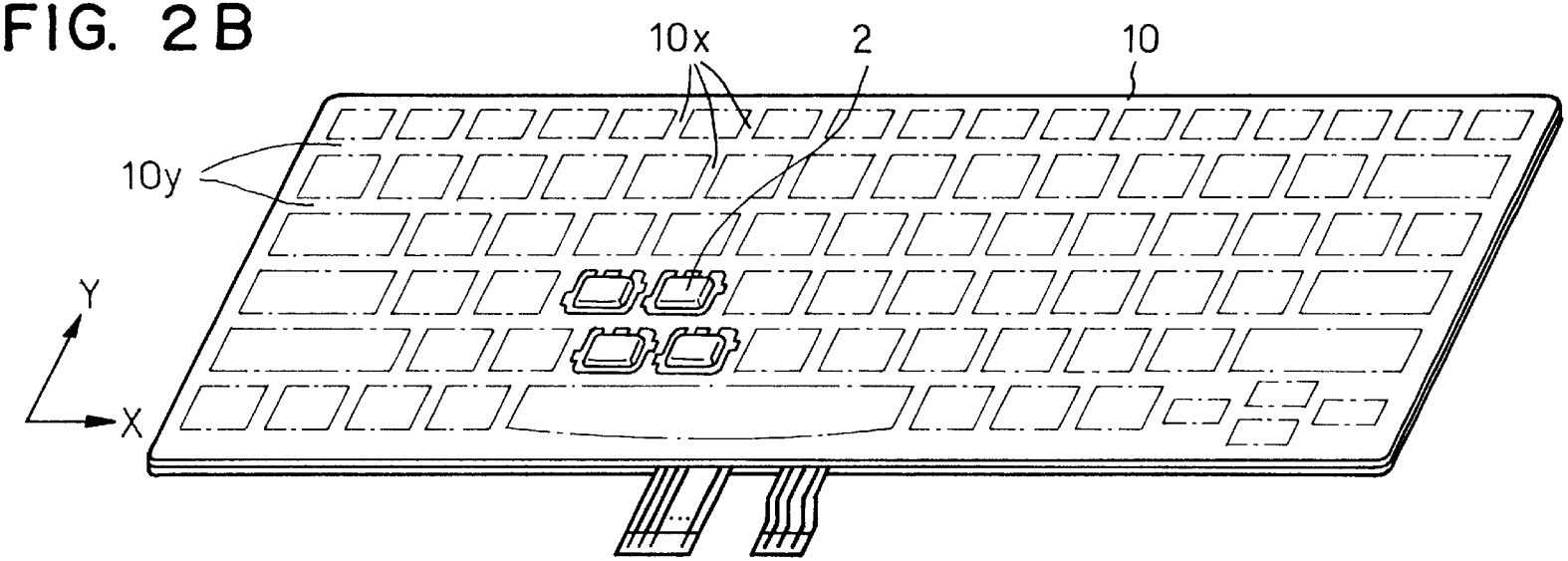
FIG. 2B is a perspective view of the housing of the keyboard according to this invention.
Figure 3A:
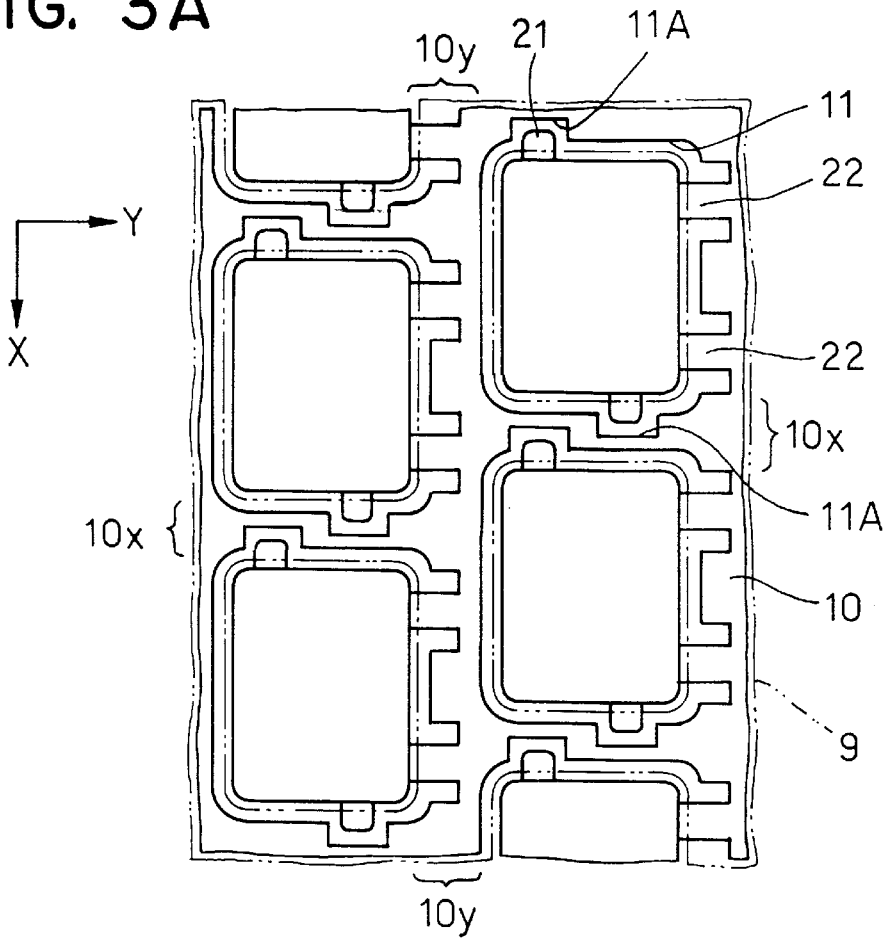
FIG. 3A is an enlarged plan view of the array of adjoining key tops.
Figure 3B:
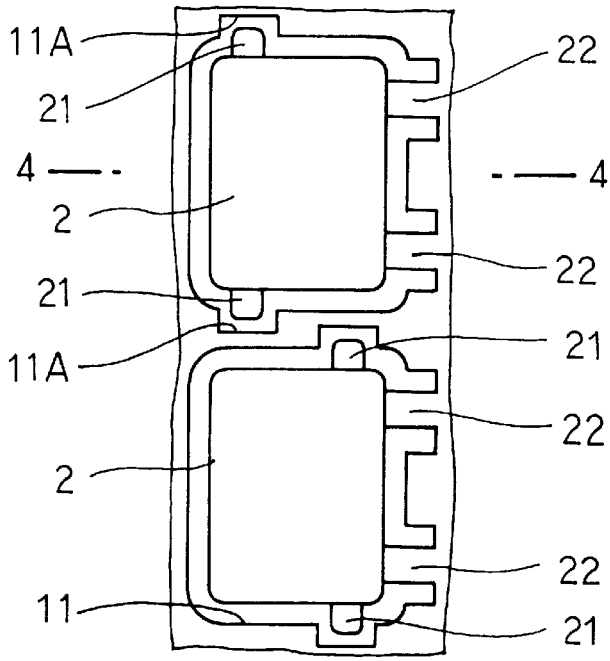
FIG. 3B is a plan view illustrating a different arrangement of the engagement flaps.
Figure 4:
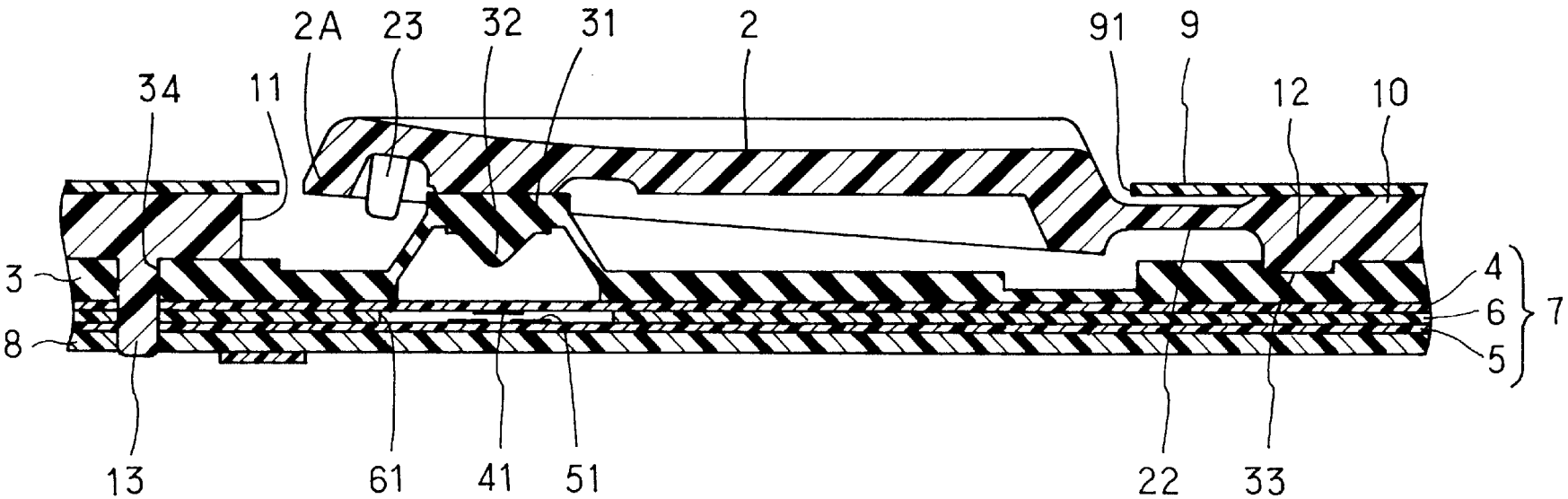
FIG. 4 is a cross-sectional view taken along the line 4—4 in FIG. 3B.
Figure 5A:
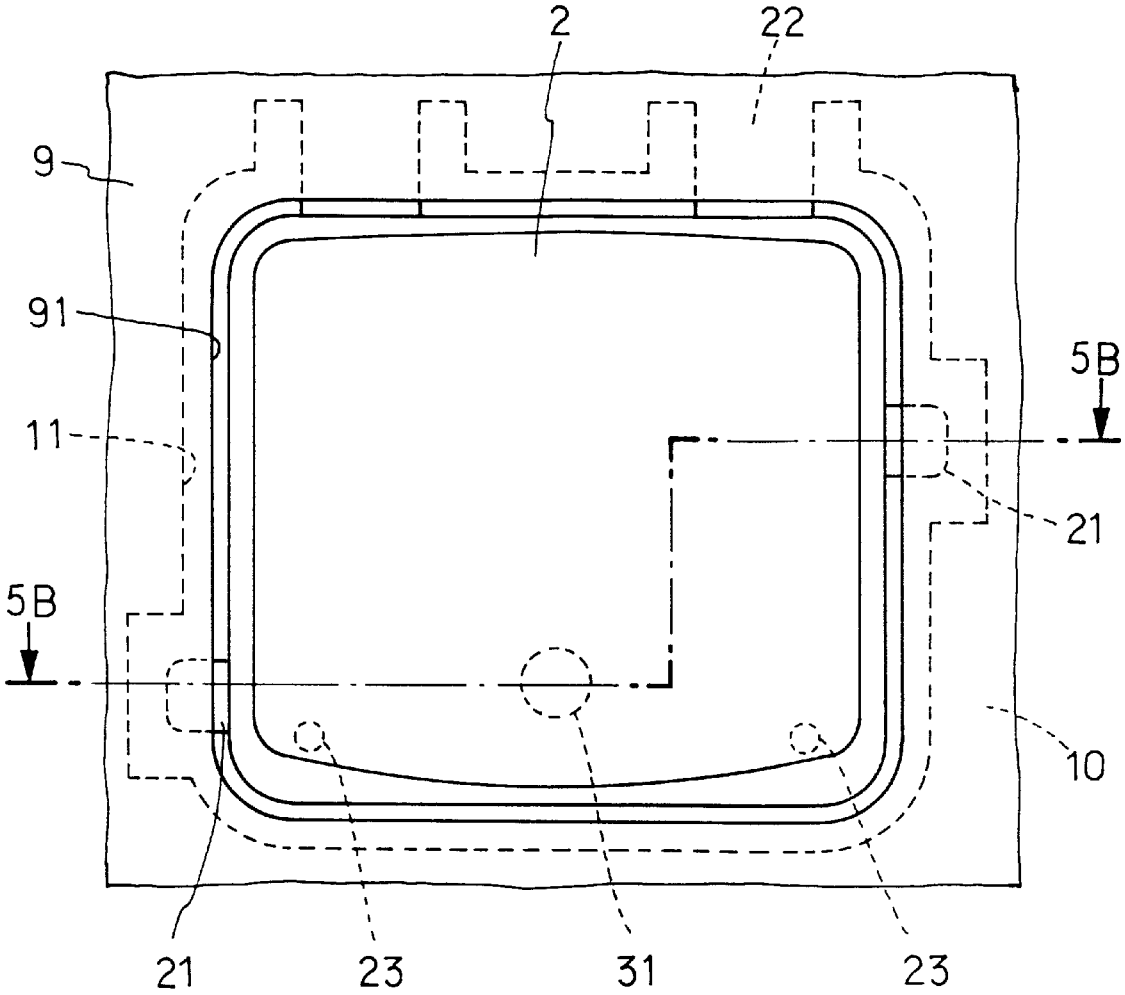
FIG. 5A is an enlarged plan view of one of the key tops.
Figure 5B:
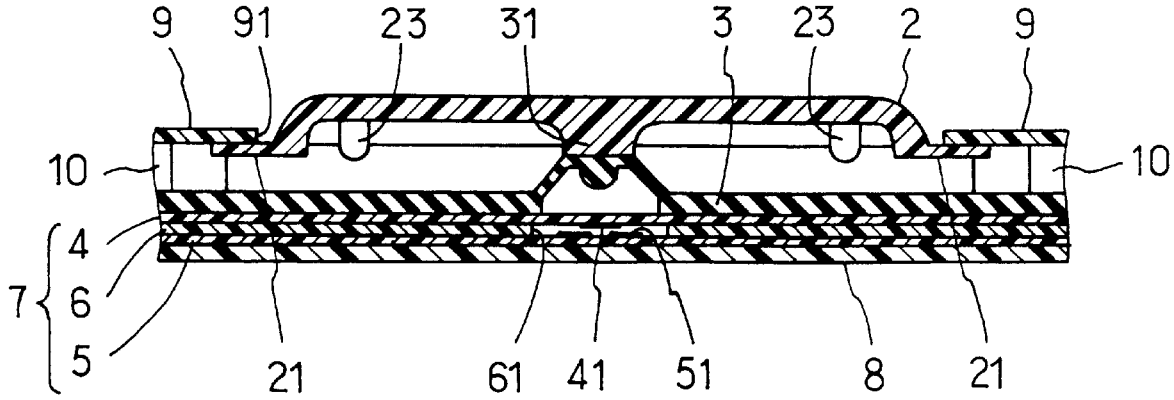
FIG. 5B is a cross-sectional view taken along the line 5B—5B in FIG. 5A.

FIG. 2A–2B is an exploded perspective view of an embodiment of the keyboard according to this invention. FIG. 3A–3B is shows four adjoining key tops and the surrounding areas in solid lines as viewed from the top of the housing 10 shown in FIG. 2A–2B with the face panel 9 thereof removed, and the face panel 9 to be attached to the upper surface of the housing 10 in broken lines. FIG. 4 is a view showing the cross section taken along the line 4—4 in FIG. 3B. FIG. 5A is an enlarged plan view of one key top and the surrounding area. FIG. 5B is a view showing the cross section taken along the line 5B—5B in FIG. 5A.

In these drawings, it is assumed that the direction of width of the keyboard is called X direction and that the direction of depth of the keyboard is called Y direction. The housing 10 of the keyboard may be manufactured by molding and machining from a highly rigid synthetic resin. The housing 10 has openings 11 formed at regular intervals. Within each of the openings 11 a square-shaped key tops 2 is formed integrally with the housing 10 by means of two hinges 22 extending from one side of the opening 11 parallel to the X direction.

For the hinge 22 that is molded integrally with the housing 10 from highly rigid synthetic resin, at least two hinges 22 are formed with a spacing therebetween in consideration for the feel of operation and the mechanical stability; for if the hinge were formed so as to extend the full length of one side edge of the square-shaped key top as in the conventional keyboard, it would be too high in flexural rigidity and hinder the operation of the key. It follows that the width of each hinge 22 is narrower than half the width of the key top 2. Each of the key tops 2 is formed with engagement flaps 21 on its opposite sides adjacent the portions where the hinges 22 are formed. As shown in FIGS. 2B and 3A, delimiting regions 10X are formed integrally with the housing 10 between widthwise adjoining openings 11 formed in an array in the housing 10. Likewise, delimiting regions 10Y are formed integrally with the housing 10 between depthwise adjoining openings 11.

Engagement tabs 21 extend from the side edges of each of the key tops 2 parallel to the depth direction into notches 11A formed in the opposed widthwise delimiting regions 10X of the housing 10. The adjacent engagement tabs 21 formed on the depthwise adjoining side edges of the adjacent key tops 2 are offset or staggered depthwise (in the Y direction) from each other so that they do not overlap or interfere with each other. In this case, the engagement tabs 21 formed on the opposite side edges of each key top 2 may be staggered depthwise from each other, as shown in FIG. 3A, or alternatively may be at the same position, as shown in FIG. 3B.

The generally square-shaped key top 2 has its peripheral edges extending downwardly to form a rim portion 2A as shown in a cross-sectional view in FIG. 4. The top face of the key top 2 is normally (when the key top is not depressed) projected upwardly through the opening 11 in the housing 10 and the key top opening 91 in the face panel 9 beyond the upper surface of the face panel 9. In this state, the lower end of the rim portion 2A lies slightly below the face panel 9 to prevent ingress of dirt into the opening 11. The key top 2 further has a pair of widthwise spaced apart stops 23 extending from the undersurface thereof adjacent the side edge (free edge) opposite the side edge where the hinges 22 are formed. These stops 23 protrude downwardly beyond the lower end of the rim portion 2A so that as the key top 2 is depressed, the protrusion 32 of the raised portion 31 comes into abutment with the movable-contact sheet 4 and that upon the key top 2 being further depressed until the movable contact 41 is brought into contact with the fixed contact 51, the lower ends of the stops 23 abut against the rubber sheet 3 to prevent any further overstroke of the key top 2 to thereby inhibit a load greater than a certain level from bearing on the raised portion 31 formed on an elastic rubber sheet 3 as will be described below.

As shown in FIG. 4, raised portions 31 are embossed in the form of a convex dome on an elastic rubber sheet 3. Each of the raised portions 31 has a protrusion 32 extending from the undersurface thereof. Each raised portion 31 underlies the key top 2 adjacent its free side edge (opposite the side edge where the hinges 22 are formed) and in the middle of the width of the key top 2. Movable contacts 41 are formed on the undersurface of a movable-contact sheet 4 in correspondence to the respective key tops 2. A fixed-contact sheet 5 is bonded to the upper surface of a substrate 8 supporting the entire keyboard. The fixed-contact sheet 5 has fixed contacts 51 are formed on the upper surface thereof in opposed relation with the respective movable contacts 41. Interposed between the movable-contact sheet 4 and the fixed-contact sheet 5 is a separator 6 formed of synthetic resin sheet having apertures 61 stamped out therethrough to define void spaces in which the respective movable contacts 41 and fixed contacts are opposed to each other to constitute contact pairs. The movable-contact sheet 4, the fixed-contact sheet 5, and the separator 6 together constitute a membrane switch (sheet) 7.

The housing 10 has formed on its undersurface at appropriate locations projections 12 configured to fit in mating recesses 33 formed in the rubber sheet 3. The housing 10 further has positioning bosses 13 formed on its undersurface at other appropriate locations, the positioning bosses 13 being adapted to fit in aligned through holes 34 formed through the rubber sheet 3, the membrane switch (sheet) 7 and the substrate 8 to thereby align the housing 10, the rubber sheet 3, the membrane switch 7 and the substrate 8. In that aligned state, the housing 10 and the substrate 8 are heat sealed integrally together.

The face panel 9 has key top openings 91 formed therethrough in alignment with the corresponding key tops 2 to receive them. Formation of the key top openings 91 through the face panel 9 define widthwise dividing regions 92X and depthwise dividing regions 92Y between the key top openings, as shown in FIG. 2A. Before the face panel 9 is attached to the housing 10, the key tops 2 formed in an array in the housing 10 as shown in FIG. 2B are supported by the hinges 22 with the engagement tabs 21 protruding upwardly beyond the upper surface of the housing 10 from the notches 11A (FIGS. 3A and 3B).

As noted above with reference to FIGS. 3A and 3B, the widthwise delimiting regions 10X are defined between the key tops 2 arrayed widthwise in the housing 10 while the depthwise delimiting regions 10Y are defined between the key tops 2 arrayed depthwise in the housing 10. Each of the widthwise delimiting regions 10X is formed with notches 11A extending from the adjacent opening 11, one on each of the opposite side edges in relation staggered in the Y direction to leave a crank-shaped web portion in delimiting regions 10X. Each of the notches 11A is adapted to receive the corresponding engagement tab 21. It will thus be appreciated that forming a notch 11A extending from the adjacent opening 11 into one side edge of each widthwise delimiting region 10X in relation staggered in the Y direction to the notch 11A extending into the opposite side edge of the delimiting region as noted above enables a reduction in the width along the X direction of each the widthwise delimiting regions 10X, resulting in reducing the pitch of the key tops and hence the width dimension of the entire width direction array of the key tops.

The face panel 9 is finally attached and secured to the entire subassembly of the housing 10, the rubber sheet 3, the membrane switch 7 and the substrate 8 integrated together by heat sealing the housing 10 and the substrate 8 together. Securing of the face panel 9 and the subassembly is effected with the widthwise dividing regions 92X of the face panel 9 in alignment with and resting on the widthwise delimiting regions 10X on the upper surface of the housing 10 and with the depthwise dividing regions 92Y of the face panel 9 in alignment with and resting on the depthwise delimiting regions 10Y on the upper surface of the housing 10. In this manner, the notches 11A formed in the delimiting region 10X are covered from above by the corresponding widthwise dividing regions 92X to act as stops for the engagement tabs 21. This always imparts upward biasing force to the key tops 2 and permits the tops of all of the key tops 2 to be maintained in the same plane.

With the keyboard as described above, upon being pressed down, the key top 2 is displaced downwardly as the hinges 22 are elastically deformed to cause the protrusion 32 to click-invert the associated raised portion 31 on the rubber sheet 3 downwardly, which in turn elastically deforms the associated movable contact 41 on the movable-contact sheet 4 downwardly into contact with the fixed contact 51 on the fixed-contact sheet 5 to thereby close the associated contact pair. Releasing the pressure on the key top 2 allows the raised portion 31 to be inverted to return to its original position to open the contact pair.

EFFECTS OF THE INVENTION

As will be appreciated from the foregoing description, when molding key tops and hinges integrally with a housing in a thin thickness using a mechanically fragile, highly rigid synthetic resin material, it is generally difficult to achieve the monolithic molding in such a manner as to locate all of the numerous key tops in the same horizontal plane. Variation in the height of the key tops as viewed in the horizontal plane is the serious major drawback inherently associated with an extremely low-profile keyboard to which this invention pertains. This invention makes it possible to maintain the key tops uniform in height by forming each of the key tops with engagement tabs and having the face panel hold down the engagement tabs of the key tops.

The stops formed on the bottom surface of each key top limit the stroke of the key top as it is pressed down, so that a load exceeding a certain level is prevented from bearing on the raised portion 31 formed on the elastic rubber sheet 3 to permit the raised portion 31 to enjoy a long life. The useful life of the hinges 22 formed of mechanically fragile, highly rigid synthetic resin material may also be lengthened.

In addition, it is possible to reduce the pitch of the key tops and hence the width dimension of the entire width direction array of the key tops by staggering the engagement tabs 21 formed on the adjoining side edges of the widthwise adjacent key tops 2 in the depth direction from each other.

Moreover, if a hinge to be molded integrally with the housing 10 from highly rigid synthetic resin material were formed so as to extend along the full length of one side edge of the key top as in the conventional keyboard, it would be too high in flexural rigidity to hinder the operation of the key. In contrast, according to this invention, the feeling of operation as well as the mechanical safety may be improved by providing two or more hinges relatively narrow in the width dimension for each key top.

Besides, it is to be understood that molding three parts, the key tops, housing and hinges in one-piece with a plurality of the hinges interconnecting each key top and the housing correspondingly reduces the number of parts required and the number of steps required to assemble the keyboard.

Further, it will be appreciated that since the key top is molded integrally with the housing 10 by means of the hinges, there is no jounce in the key top movement.

What is claimed is:

1. A keyboard comprising:

a rectangular housing made of rigid synthetic resin having width dimensions greater than depth dimensions, said housing having a plurality of quadrilateral openings formed therethrough and arrayed at intervals both in the width direction and in the depth direction so as to define widthwise delimiting regions between each widthwise adjacent openings, each of said widthwise delimiting regions having notches cut in from two opposed side edges of the widthwise adjacent openings, said notches being staggered depthwise from each other;

quadrilateral key tops, each disposed within one of said openings and formed integrally with said housing by means of at least two hinges extending from one side edge of the key top parallel to the width direction, each of said key tops having engagement tabs extending oppositely outward from two opposed side edges thereof adjoining said side edge where said hinges are formed, said engagement tabs entering into said notches formed in the opposed corresponding side edges of said openings;

an elastic rubber sheet attached to the undersurface of said housing and having upwardly convex raised portions embossed thereon in correspondence to the corresponding key tops;

a movable-contact sheet having movable contacts formed on the undersurface thereof in correspondence to the corresponding key tops;

a fixed contact sheet having fixed contacts formed thereon in spaced opposed relation to the corresponding movable contacts;

a separator interposed between said movable-contact sheet and said fixed-contact sheet and having apertures formed therethrough to define void spaces surrounding the corresponding opposed movable contacts and fixed contacts, said movable-contact sheet, said fixed-contact sheet, and said separator together constitute a membrane switch attached to the undersurface of said rubber sheet; and a face panel attached to the upper surface of said housing and having key top openings formed therethrough and arrayed at intervals both in the width direction and in the depth direction, said key top openings having the corresponding key tops protrude upwardly therethrough.

2. The keyboard of claim 1 wherein the width of each of said hinges is less than half the width of each of said key tops.

3. The keyboard of claim 1 wherein said hinges of each of said key tops is given biasing force to protrude said associated key top upwardly through the corresponding key top opening.

4. The keyboard of any one of preceding claims 1 to 3 wherein said engagement tabs formed on the opposite side edges of each of said key tops are staggered depthwise from each other.

5. The keyboard of any one of preceding claims 1 to 3 wherein said engagement tabs formed on the opposite side edges of each of said key tops are located in the same position in the depth direction.

6. The keyboard of any one of preceding claims 1 to 3 wherein each of said key tops peripheral edges extending downwardly to form an integral rim portion, the top face of said key top being projected upwardly through the associated opening in said housing and the associated key top opening in said face panel beyond the upper surface of the face panel when the key top is released, and the lower end of the rim portion lying slightly below the face panel.

7. The keyboard of claim 6 wherein each of said key tops has stop means extending from the undersurface thereof adjacent a free side edge opposite the side edge where the hinges are formed, said stop means protruding downwardly beyond the lower end of said rim portion.

8. The keyboard of any one of preceding claims 1 to 3 wherein said housing has integral positioning bosses extending downwardly from the undersurface thereof, the positioning bosses being inserted in positioning through holes formed through said rubber sheet and said membrane switch.

9. The keyboard of any one of preceding claims 1 to 3 wherein each of said raised portions are located under the corresponding key top adjacent its free side edge.

* * * * *